US009371711B2

(12) United States Patent
Foubister et al.

(10) Patent No.: US 9,371,711 B2
(45) Date of Patent: Jun. 21, 2016

(54) TEST PACKER AND METHOD FOR USE

(71) Applicant: Weatherford Technology Holdings, LLC, Houston, TX (US)

(72) Inventors: Graeme Foubister, Aberdeen (GB); Graeme K. Smith, Aberdeen (GB); Andrew Thomson, Laurencekirk (GB); Kannan Devarajan, Dubai (AE); Andres Fuenmayor, Dubai (AE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 14/502,551

(22) Filed: Sep. 30, 2014

(65) Prior Publication Data

US 2015/0013971 A1 Jan. 15, 2015

Related U.S. Application Data

(62) Division of application No. 13/345,578, filed on Jan. 6, 2012, now Pat. No. 8,851,166.

(60) Provisional application No. 61/430,916, filed on Jan. 7, 2011, provisional application No. 61/533,071, filed on Sep. 9, 2011.

(51) Int. Cl.

| | |
|---|---|
| ***E21B 33/12*** | (2006.01) |
| ***E21B 33/129*** | (2006.01) |
| ***E21B 47/10*** | (2012.01) |
| ***E21B 21/14*** | (2006.01) |
| ***E21B 23/02*** | (2006.01) |
| ***E21B 34/10*** | (2006.01) |
| ***E21B 43/08*** | (2006.01) |

(52) U.S. Cl.

CPC ..... *E21B 33/1294* (2013.01); *E21B 21/14* (2013.01); *E21B 23/02* (2013.01); *E21B 34/10* (2013.01); *E21B 43/08* (2013.01); *E21B 47/1025* (2013.01)

(58) Field of Classification Search

CPC ..... E21B 33/1294

USPC ..... 166/133, 129, 183, 115, 116, 188, 166/250.07, 387, 386, 184, 332.8, 334.1, 166/250.17, 250.01, 179, 117.7

See application file for complete search history.

(56) References Cited

U.S. PATENT DOCUMENTS 7,510,016 B2 * 3/2009 Telfer ..... E21B 33/128 166/120

* cited by examiner

*Primary Examiner* — Jennifer H Gay
*Assistant Examiner* — Steven MacDonald
(74) *Attorney, Agent, or Firm* — Smith IP Services, P.C.

(57) ABSTRACT

A downhole tool having a throughbore is disclosed for use in a tubular located in a wellbore. The downhole tool has a sealing element configured to seal an annulus between the downhole tool and an inner wall of the tubular; at least one flow path formed in the downhole tool, wherein the flow path is configured to allow fluids in the annulus to flow past the sealing element when the sealing element is in a sealed position; and at least one valve in fluid communication with the flow path and configured to allow the fluids to flow through the flow path in a first direction while preventing the fluids from flowing through the flow path in a second direction. A guard may be installed proximate anchor elements. The guard extends radially beyond an outer diameter of the anchor elements when the anchor elements are in a retracted position.

21 Claims, 13 Drawing Sheets

TEST PACKER AND METHOD FOR USE

STATEMENTS REGARDING FEDERALLY SPONSORED RESEARCH OR DEVELOPMENT

Not Applicable.

NAMES OF THE PARTIES TO A JOINT RESEARCH AGREEMENT

Not Applicable.

BACKGROUND

Embodiments of the invention relate to techniques for controlling fluid flow in a wellbore. More particularly, the invention relates to techniques for controlling fluid flow through a flow path and past a sealing element of a downhole tool.

Oilfield operations may be performed in order to extract fluids from the earth. During construction of a wellsite, casing may be placed in a wellbore in the earth. The casing may be cemented into place once it has reached a desired depth. Smaller tubular strings or liners may then be run into the casing and hung from the lower end of the casing to extend the reach of the wellbore. The connection between the liner and the casing has a potential to leak. The leaks may cause fluid from within the casing to enter downhole reservoirs thereby damaging the reservoirs. Further, the leaks may allow reservoir fluids to escape from the reservoir and create a blowout situation within the wellbore. There is a need to test the liner overlap in a more efficient, reliable and time saving manner.

SUMMARY

A downhole tool having a throughbore is disclosed for use in a tubular located in a wellbore. The downhole tool has an anchor element configured to secure the downhole tool to an inner wall of the tubular; a sealing element configured to seal an annulus between the downhole tool and the inner wall of the tubular; at least one flow path formed in the downhole tool, wherein the flow path is configured to allow fluids in the annulus to flow past the sealing element when the sealing element is in a sealed position; and at least one valve in fluid communication with the flow path and configured to allow the fluids to flow through the flow path in a first direction while preventing the fluids from flowing through the flow path in a second direction. A guard may be installed proximate the anchor elements. The guard extends radially beyond an outer diameter of the anchor elements when the anchor elements are in a retracted position.

A method for testing a liner overlap in a wellbore is also disclosed having the steps of running the downhole tool into the tubular in the wellbore to a location proximate the liner overlap; engaging the inner wall of the tubular with the sealing element thereby sealing the annulus between the downhole tool and the tubular;

displacing the first fluid in the first direction through the flow path in the downhole tool thereby bypassing the engaged sealing element; prohibiting fluid flow through the flow path in the second direction; and pressure testing the liner overlap.

A packer for use in a wellbore is also disclosed. The packer has a body having an axial throughbore; a sealing element mounted to the body for sealing the annulus between the packer and the wellbore; a first fluid bypass which allows the fluid in the annulus to be displaced around the sealing element while the sealing element is not in sealing engagement with the wellbore; and a second fluid bypass which allows fluid in the annulus to be displaced around the sealing element while the sealing element is in sealing engagement with the wellbore.

BRIEF DESCRIPTION OF THE DRAWINGS

The embodiments may be better understood, and numerous objects, features, and advantages made apparent to those skilled in the art by referencing the accompanying drawings. These drawings are used to illustrate only typical embodiments of this invention, and are not to be considered limiting of its scope, for the invention may admit to other equally effective embodiments. The figures are not necessarily to scale and certain features and certain views of the figures may be shown exaggerated in scale or in schematic in the interest of clarity and conciseness.

DESCRIPTION OF EMBODIMENT(S)

The description that follows includes exemplary apparatus, methods, techniques, and instruction sequences that embody techniques of the inventive subject matter. However, it is understood that the described embodiments may be practiced without these specific details.

Figure 1:
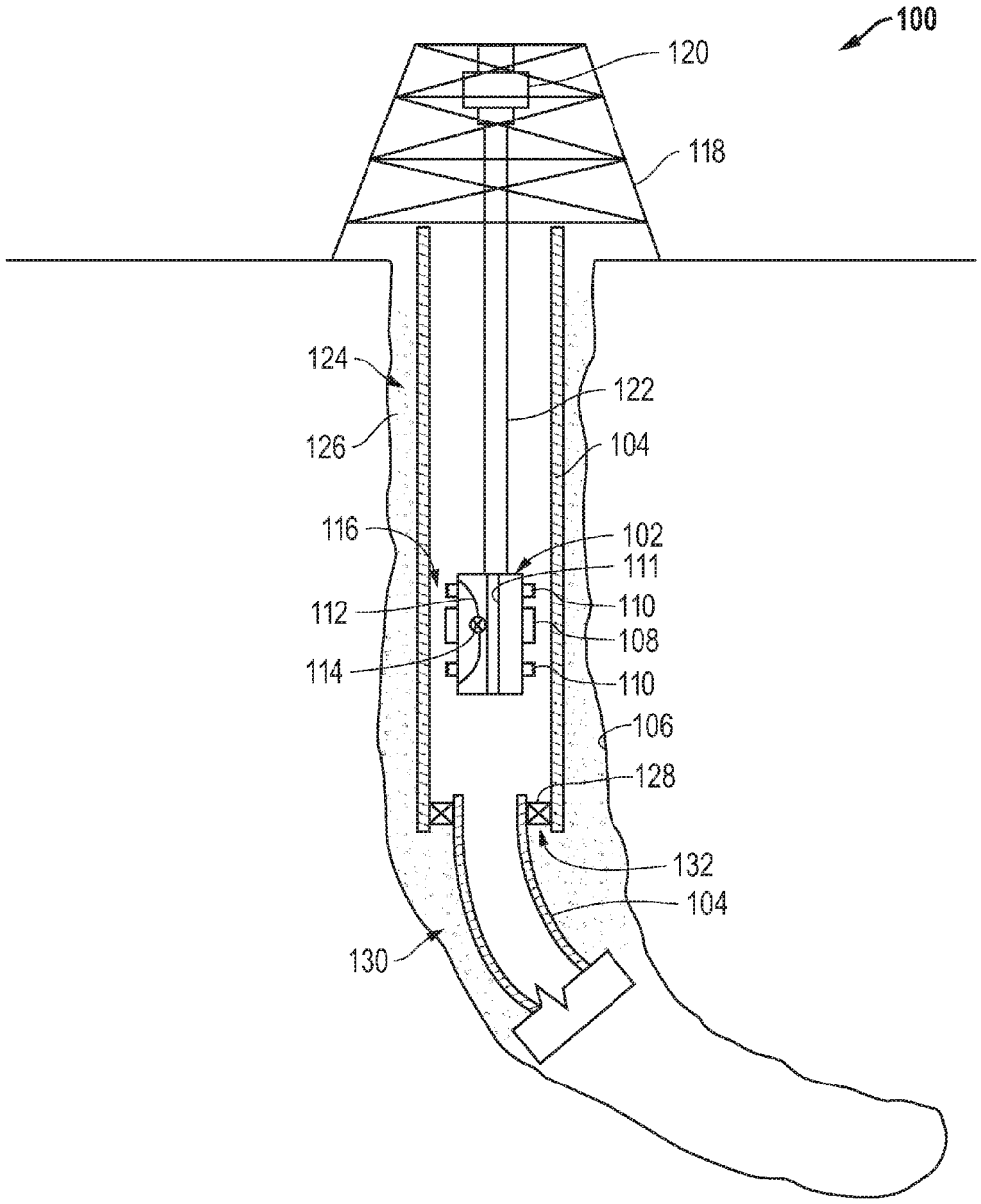
FIG. 1 depicts a schematic diagram, partially in cross-section, of a wellsite having a downhole tool with a sealing element and a flow path to allow fluids to selectively by-pass the sealing element in an embodiment.

FIG. 1 shows a schematic diagram depicting a wellsite 100 having a downhole tool 102 for sealing a tubular 104 in a wellbore 106. The downhole tool 102 has a throughbore 111, may have one or more sealing elements 108, one or more anchor elements 110, a flow path 112 and one or more valves 114. The anchor elements or anchor members 110 may be configured to anchor and/or secure the downhole tool 102 to an inner wall of the tubular 104. The sealing element 108, or packer element, may be configured to seal an annulus 116 between the downhole tool 102 and the inner wall of the tubular 104. The flow path 112 may allow fluid in the annulus 116, and/or the fluid about the downhole tool 102, to pass the sealing element 108 when the sealing element 108 is in a set position, or sealed position. The valve 114 may control the flow of the fluid through the flow path 112, as will be described in more detail below.

The wellsite 100 may have a drilling rig 118 located above the wellbore 106. The drilling rig 118 may have a hoisting device 120 configured to raise and lower the tubular 104 and/or the downhole tool 102 into and/or out of the wellbore 106. The hoisting device 120, as shown, is a top drive. The top drive may lift, lower, and rotate the tubular 104 and/or a conveyance 122 during wellsite 100 operations. The top drive may further be used to pump cement, drilling mud and/or other fluids into the tubular 104, the conveyance 122 and/or the wellbore 106. Although the hoisting device 120 is described as being a top drive, it should be appreciated that any suitable device(s) for hoisting the tubular 104 and/or the conveyance 122 may be used such as a traveling block, and the like. Further any suitable tools for manipulating the tubular 104, the conveyance 122 and/or the downhole tool 102 may be used at the wellsite 100 including, but not limited to, a Kelly drive, a pipe tongs, a rotary table, a coiled tubing injection system, a mud pump, a cement pump and the like.

The tubular 104 shown extending from the top of the wellbore 106 may be a casing. The casing may have been placed into the wellbore 106 during the forming of the wellbore 106 or thereafter. Once in the wellbore 106, a casing annulus 124 between the casing and the wellbore 106 wall may be filled with a cement 126. The cement 126 may hold the casing in place and seal the wall of the wellbore 106. The sealing of the wellbore wall may prevent fluids from entering and/or exiting downhole formations proximate the wellbore 106. The casing may be any suitable sized casing for example, a 10.75" casing, a 9.625" casing, and the like.

Below the casing a second tubular string 104 and/or liner may be secured in the wellbore 106. The liner may be hung from the lower end of the casing using a liner hanger 128. Once the liner hanger 128 secures the liner to the casing, cement 126 may be pumped into a liner annulus 130 between the liner and the wellbore 106 wall in a similar manner as described with the casing. The hung and cemented liner forms a liner overlap 132, or joint, between the casing and the liner. The liner overlap 132 may have a potential for leaking during the life of the wellbore 106. The downhole tool 102 may be used to pressure test the liner overlap 132, or joint, as will be described in more detail below. The downhole tool 102, independently and/or in conjunction with other tools in the string, may also be used to complete the liner overlap 132, for example by cleaning, milling, and/or scrubbing the liner overlap 132 in a single trip operation. Although the tubulars 104 are described as being a casing and a liner, it should be appreciated that the tubular 104 may be any suitable downhole tubular including, but not limited to a drill string, a production tubing, a coiled tubing, an expandable tubing, and the like.

The downhole tool 102 may be lowered into the wellbore 106 using the conveyance 122. The conveyance 122, as shown, is a drill string that may be manipulated by the hoisting device 120 and/or any suitable equipment at the wellsite 100. Although the conveyance 122 is described as a drill string, it should be appreciated that any suitable device for delivering the downhole tool 102 into the wellbore 106 may be used including, but not limited to, any tubular string such as a coiled tubing, a production tubing, a casing, and the like.

Figure 2A:
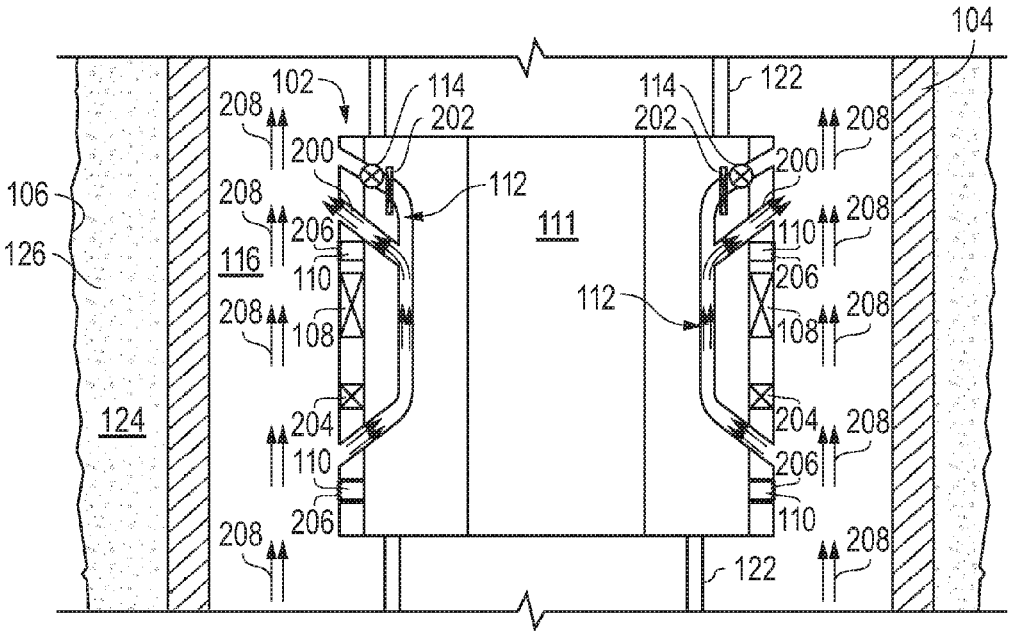
FIGS. 2A-2C depict schematic diagrams of the downhole tool of FIG. 1 in an embodiment.

FIG. 2A depicts a schematic view of the downhole tool 102 in a run in position. In the run in position, the one or more sealing elements 108 and the one or more anchor elements 110 may be in a retracted position proximate an outer diameter of the downhole tool 102. The retracted run in position may allow the downhole tool 102 to move within the tubular 104 without engaging the inner wall of the tubular 104 with the downhole tool 102 equipment and thereby damaging the equipment of the downhole tool 102 and/or the tubular 104. During run in of the downhole tool 102, fluids in the tubular 104 may pass through the annulus 116. In addition, the fluids may flow through the flow path 112.

In an embodiment, a run-in flow path 200 may be provided. The run-in flow path 200 may be open, or in fluid communication with the flow path 112, during run in, and/or while the downhole tool 102 is in the run in position. While the run-in flow path 200 is open, a sleeve 202 and/or the valve 114 may be in a closed position thereby preventing flow of the fluids through the valve 114. Further fluid communication between the flow path 112 and the valve 114 may be prohibited when the run-in flow path 200 is in the open position. The run-in flow path 200 may allow the fluids to flow into and out of the run-in flow path 200 during run in of the downhole tool 102. If sleeve 202 is open, only sufficient flow or pressure from below could cause the valve 114 (normally biased closed) to open during run in. Prohibiting the fluids from passing through the valve 114 during run in may minimize failure of the valve 114 by keeping the valve free of debris until the sealing element 108 is set.

In an alternative embodiment, one or more valves 114 may always be in communication with the flow path 112. In this embodiment, the fluids may pass through the valve 114 during run in. In this embodiment, the run-in flow path 200 may be an additional fluid path during run in, or may be eliminated.

The sealing element 108 and the anchor elements 110 may be in a retracted position when the downhole tool 102 is in the run in position. In the retracted position, the one or more sealing elements 108 and/or the one or more anchor elements 110 may be recessed or flush with an outer diameter of the downhole tool 102. Having the one or more sealing elements 108 and/or the one or more anchor elements 110 recessed may prevent the anchor elements 110 and/or the sealing elements 108 from being damaged during run in.

As the downhole tool 102 is run into the tubular 104, fluids in the tubular 104 may flow past the downhole tool 102. The outer diameter of the downhole tool 102 may be slightly smaller than the inner diameter of the tubular 104. During run in the fluids within the tubular 104 may impede the travel of the downhole tool 102 as the fluids are forced into the annulus 116. The flow path 112 and/or the run-in flow path 200 may allow an additional volume of fluids to flow past the downhole tool 102 in addition to the annular flow during run in. As shown in FIG. 2A, the fluids flow into the flow path 112 and out of the run-in flow path 200 during run in, in addition to flowing through the annulus 116. The flow of the fluids through the flow path 112 of the downhole tool 102 may reduce and/or minimize the flow in the annulus 116. The minimized flow in the annulus 116 may reduce the amount of debris engaging the anchor elements 110 and/or the sealing elements 108 during run in.

There may be any number of flow path(s) 112 and/or run-in flow path(s) 200 in the downhole tool 102. The flow path(s) 112 may be completely independent of the run-in flow path(s) 200; or the run-in flow path(s) 200 may branch off of the flow path(s) 112. Multiple flow path(s) 112 and/or run-in flow path(s) 200 may, by way of example only, run in parallel. In an embodiment, there may be three flow paths 112 and three run-in flow paths 200. The one or more valves 114 may be provided for each of the flow paths 112 in order to control fluid flow once the downhole tool 102 is set in the tubular 104. Further, there may be any number and/or arrangement of flow paths 112, run-in flow paths 200 and/or valves 114. For example, the flow paths 112 may form an annular flow path that is in communication with one or more of the run-in flow paths 200. The annular flow path may fluidly communicate to one valve 114, or multiple valves 114. Further, each of the flow paths may have multiple valves 114.

Figure 4A:
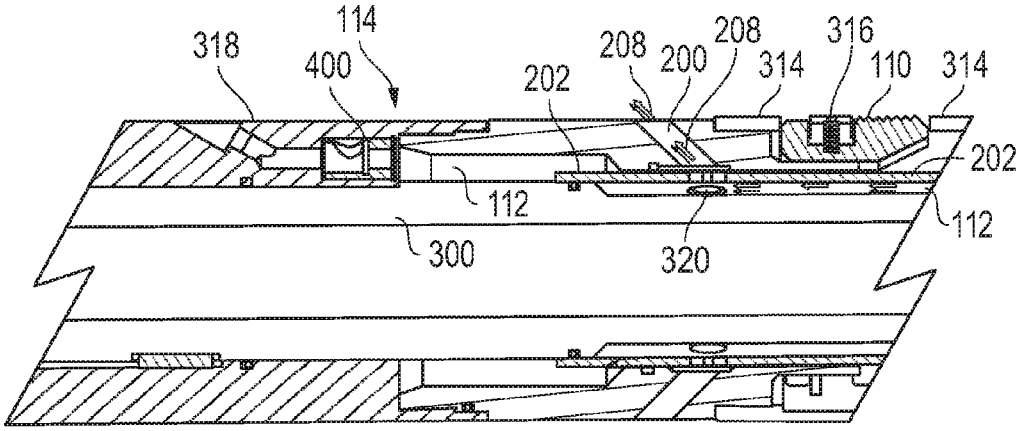
FIGS. 4A-4D depict a partial cross sectional view of the downhole tool in various positions used in operation of the downhole tool.

The downhole tool 102 may have the sleeve (or second valve) 202 for controlling the flow of fluids in the flow path 112 and/or the run-in flow path 200. The sleeve 202 may prevent fluid communication with the one or more valves 114 during run in while allowing fluid to flow through the run-in flow path 200, as shown in FIGS. 2A and 4A. Upon setting the downhole tool 102 in the tubular 104, the sleeve 202 may allow fluid communication with the one or more valves 114 while preventing fluid to flow into the run-in flow path 200. Although fluid communication in the flow path 112 is described as being controlled by the sleeve 202, it may be controlled by any suitable device such as one or more valves, multiple sleeves, and the like.

The one or more valves 114, shown schematically, may be one or more one way valve. The one or more valves 114 are normally biased closed unless there is sufficient flow pressure from the one direction for forcing the valve(s) 114 open. The one way valve may allow the fluids to flow in a first direction, for example from below the sealing element 108 to a location above the sealing element 108, while preventing the fluids from flowing in a second direction, for example from above the sealing element 108 to a location below the sealing element 108. Although the one or more valves 114 is described as allowing flow from below the sealing element 108 (the first direction) while preventing flow from above the sealing element 108 (the second direction), it should be appreciated that the one or more valves 114 may allow fluid flow in the second direction while prohibiting fluid flow in the first direction. The one or more valves 114 may be any suitable valve for allowing one way flow including, but not limited to, a check valve, a ball valve, a flapper valve, a bypass valve, and the like. As an alternative, the one or more valves 114 may be a control valve that may be selectively opened or closed.

One or more actuators 204, shown schematically may be located in the downhole tool 102. The one or more actuators 204 may actuate the one or more sealing elements 108, the one or more anchor elements 110, and/or the sleeve 202. There may be one actuator 204 configured to actuate the one or more sealing elements 108, the one or more anchor elements 110, and the sleeve 202 together, or multiple actuators 204. The actuators 204 may be hydraulic actuators and/or mechanical actuators, as will be described in more detail below. Further, the actuators 204 may be any suitable actuators, or combination of actuators, for actuating the one or more sealing elements 108, the one or more anchor elements 110, and/or the sleeve 202 including, but not limited to, a mechanical actuator, a pneumatic actuator, an electric actuator, and the like.

The sealing element 108, shown schematically, may be an elastomeric annular member that expands into engagement with the inner wall of the tubular 104 upon compression. The actuator 204 may cause the sealing element 108 to compress thereby expanding radially away from the downhole tool 102 and into engagement with the inner wall of the tubular 104. Although the sealing element 108 is described as the elastomeric annular member, it should be appreciated that the sealing element 108 may be any suitable member for sealing the annulus 116.

The anchor elements 110, shown schematically, may be any device and/or member for securing the downhole tool 102 to the inner wall of the tubular 104. In an embodiment, the anchor elements 110 may be one or more slips having one or more teeth 206. The teeth 206 may be configured to engage and penetrate a portion of the inner wall of the tubular 104 upon actuation. The teeth 206 may prevent the movement of the downhole tool 102 once actuated. Although the anchor elements 110 are described as being one or more slips having teeth 206, the anchor elements may be any suitable device for securing the downhole tool 102 to the tubular 104.

In addition to the anchor elements 110, the sealing element 108, the flow path 112 and the valve 114, the downhole tool 102 may have any suitable equipment for cleaning out and/or completing the liner overlap 132. For example, the downhole tool 102 may include, but is not limited to one or more of, scrapers, brushes, magnets, additional packers, downhole filters, circulation tools, mills, one or more motors, ball catcher, scraper for cleaning the tubular 104 proximate the sealing element 108 for cleaning prior to setting the sealing element 108, pressure gauges, sensors (for monitoring flow, pressure temperature, fluid density, flow rate), and the like. Having the clean out and/or completion equipment on the downhole tool 102 may allow a clean out operation to be performed on the liner overlap 132 with the same tool that is used to pressure test (both positive and negative pressure testing) the liner overlap 132. This may eliminate trips into the wellbore 106 thereby reducing the cost of the completion operation. A positive pressure test may be wherein the fluid pressure inside the tubular 104 is higher than the fluid pressure inside the reservoir. A negative pressure test may be wherein the fluid pressure inside the tubular 104 is lower than the fluid pressure inside the reservoir.

Figure 2B:
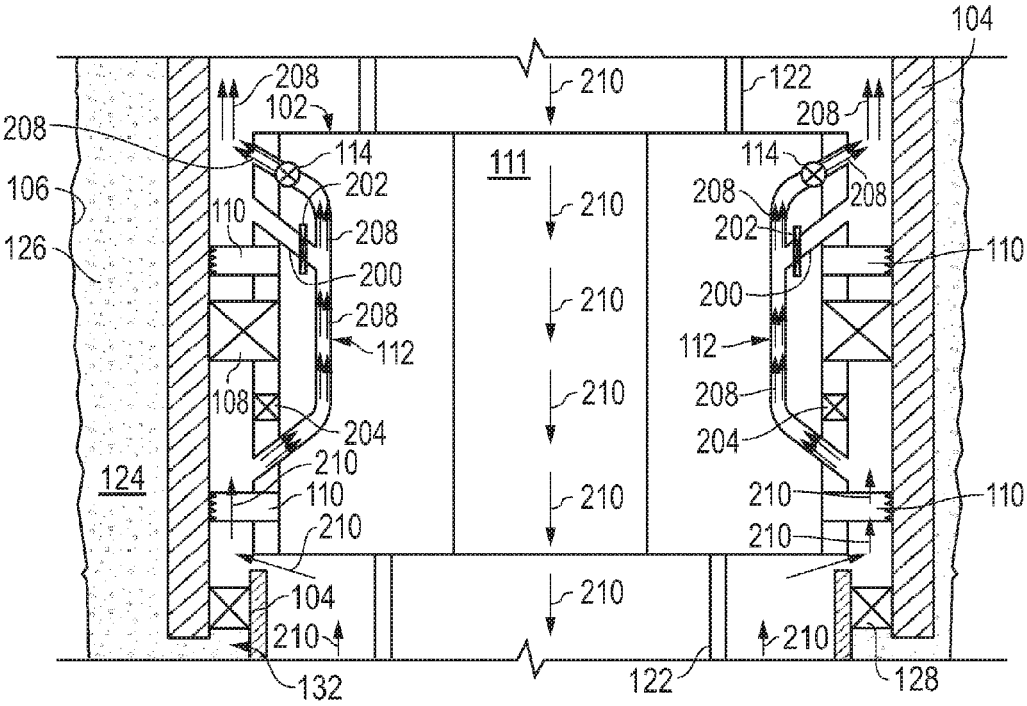

FIG. 2B depicts a schematic view of the downhole tool 102 in a set position in the tubular 104. In the set position the downhole tool 102 may be at a set location in the tubular 104. The set location may be any suitable location for sealing the tubular 104. As shown the set location is at the liner overlap 132. The liner overlap 132 may need to be pressure tested using the downhole tool 102 to ensure that there is no leaking at the liner overlap 132. The fluids typically found in the tubular 104 may be heavy drilling mud. The drilling mud may impede a pressure test at the liner overlap 132 by acting as a sealing barrier. Therefore, the downhole tool 102 may be used to evacuate the heavy fluids proximate the liner overlap 132 to a location above the sealing element 108. Lighter fluids may then be used to test the integrity of the liner overlap 132. Upon reaching the set location, the operator and/or a controller, may activate the one or more actuators 204 to set the downhole tool 102 in the set position.

Once at the set location, the actuators 204 may engage the tubular 104 with the anchor elements 110. The actuators 204 may then engage the sealing element 108 with the inner wall of the tubular 104 thereby sealing the annulus 116. The actuators 204 may also move the sleeve 202 to a location that prohibits flow out of the run-in flow path 200 while allowing fluid communication with the valve 114. The downhole tool 102 is now in the set position, or test position.

With the downhole tool 102 in the set position, the liner overlap 132 may be pressure tested. The heavy fluids 208, depicted by two arrows, may need to be removed from the location proximate the liner overlap 132. The higher density fluids or heavy fluids 208 may be drilling muds and the like. A light weight fluid 210, depicted by one arrow, may be pumped down the conveyance 122 and out of the downhole tool 102. The lighter density fluids or light weight fluid 210 may be any suitable fluid including, but not limited to, base oil, brine, and the like. The light weight fluids 210 may push the heavy fluids 208 in the conveyance 122 and/or the downhole tool 102 into the annulus 116 while the lighter fluids 210 may remain in the conveyance 122 and the downhole tool 102. Having the lighter fluids 210 in the conveyance 122 and/or downhole tool 102 may create a differential pressure across the liner overlap 132 while maintaining the well control barrier, wherein heavy fluids are in the annulus 116 and lighter fluids are in the downhole tool 102 and/or conveyance 122. With the differential pressure profile established, back pressure on the annulus 116 above the sealing element 108 may be reduced. This pressure reduction may cause the lighter fluids 210 to push the heavier fluids 208 into the flow path 112 and past the valve 114. The lighter fluids 210 may be used to evacuate the heavy fluids 208 from proximate the liner overlap 132. The fluid levels may be monitored using any suitable monitoring devices. The valve 114 may prevent a U-tube effect where heavier fluids migrate into the conveyance 122.

With the heavy fluid evacuated, the liner overlap 132 may then be pressure tested using the lighter fluids 210. If the liner overlap 132 fails, the reservoir fluids/gas (not shown) may migrate up the conveyance 122 due to the lighter hydrostatic pressure profile. This may allow the reservoir fluids to be detected and controlled safely. As a working example, but not limited to, a typical pressure above packer, or sealing element 108, is approximately 9,000 psi (pounds per square inch) with a pressure below of approximately 6500 psi. The differential pressure across the downhole tool 102 may be approximately 2,500 psi which will retain the flapper valve (e.g. valve 114) in the closed position. A pressure greater than approximately 9,000 psi from below the packer will force the flapper (e.g. valve 114) open. There may be a number of pressure regimes that may apply which will vary on a well by well basis where the maximum differential pressure will be dependent on sealing element configuration and/or material selection.

Figure 2C:
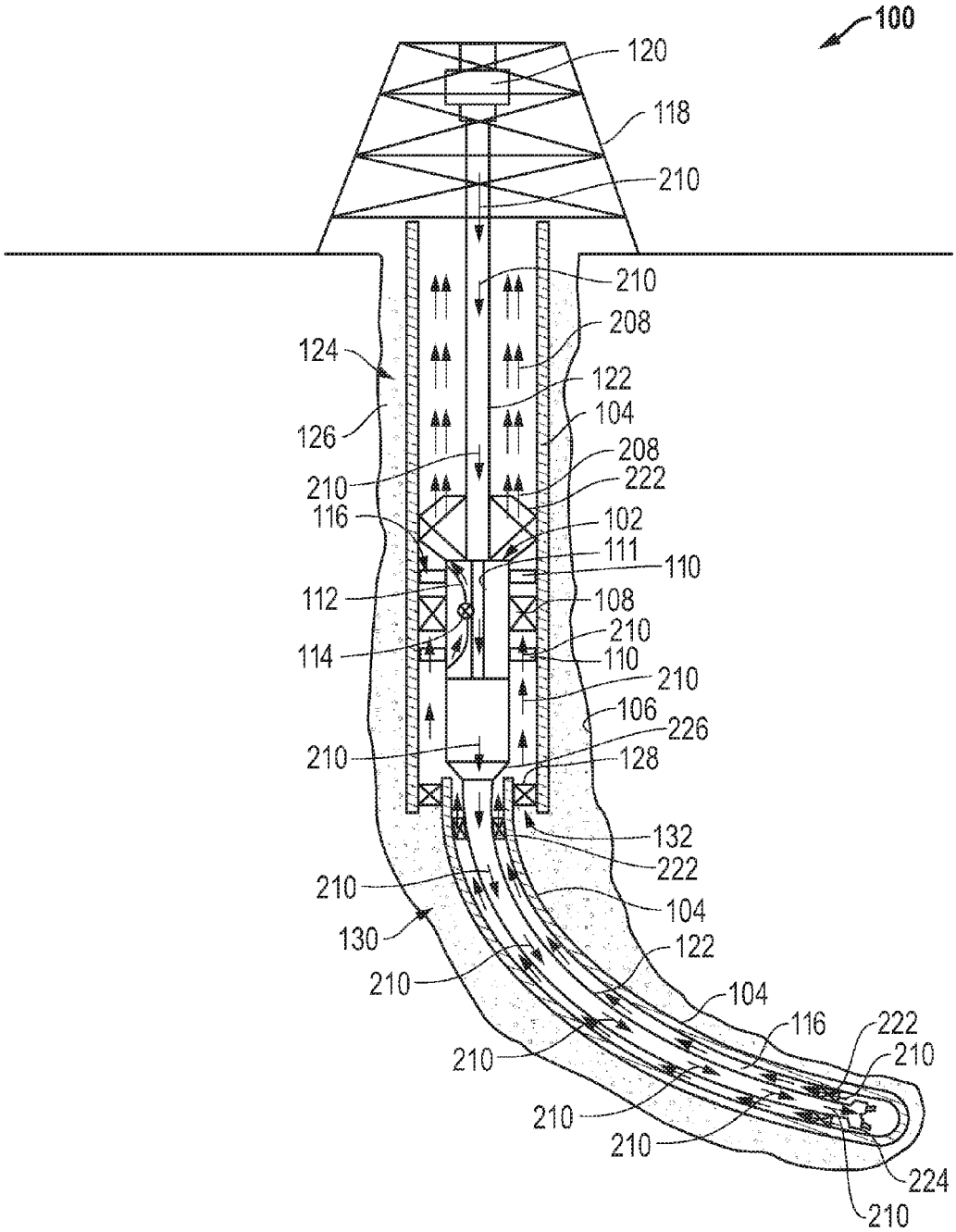

FIG. 2C depicts a schematic view of the downhole tool 102 in a set position in the tubular 104. Attached to the conveyance 122 and/or the downhole tool 102 there may be any number of tools for performing operations in the wellbore 106. For example, there may one or more scrapers 222, a drill bit 224, and/or a dressing mill 226, and any suitable tools, devices and/or equipment described herein. The conveyance 122 with the tool string may be run into the tubular 104 in the wellbore 106. The scrapers 222 may be manipulated by the conveyance 122 in order to clean and/or scrape the inner walls of the tubulars 104. The drill bit 224 may be rotated to clear any obstructions inside the tubulars 104. The dressing mill 226 may be rotated and engaged against the top of the liner in order to dress the liner top. Further, the inner wall of the tubular 104 wherein the sealing elements 108 are to be set may be scraped in order to clean the tubular 104 prior to setting the sealing element 108. During scraping, the drilling, and/or the milling, the heavy fluids 208 may continue to be circulated to carry away debris. As an alternative, or in addition, the lighter fluids 210 may be circulated at this time. Then the downhole tool 102 may be used to test the liner.

In order to test the liner and/or the liner overlap 132, the downhole tool 102 may be set. The downhole tool 102 may be set hydraulically by dropping a ball on a ball seat and applying pressure to the actuators 204. Further, the downhole tool 102 may be set using any suitable actuators 204 and/or methods for setting the actuators 204. After the downhole tool 102 has been set, the ball may be removed to a ball catcher to allow for fluid flow through the throughbore 111. The lighter fluid 210 may then be pumped down the conveyance 122 and out the bottom of the conveyance 122 (as shown out of the drill bit 224). The lighter fluids 210 may then enter the annulus 116. The lighter fluid 210 and/or back pressure applied to the annulus 116 above the downhole tool 102 may cause the heavier fluids 208 to flow up the annulus 116 toward the downhole tool 102. The heavier fluid 208 will continue to flow up the annulus 116 through the flow path 112 and past the valve 114 as the lighter fluid 210 is pumped down. The lighter fluid 210 may continue to be pumped into the conveyance 122 until substantially all of the heavier fluids 208 have been displaced past the valve 114 as shown in FIG. 2C. The pumping may then cease and/or the pressure of the heavier fluids in the annulus 116 above the sealing element 108 may be increased in order to close the valve 114. The higher pressure above the valve 114 may maintain the valve 114 in the closed position while pressure testing the liner below the sealing element 108.

Once pressure testing has been successfully completed, circulation of the lighter fluid 210 may be commenced to displace the heavy fluid 208 out of the wellbore 106. Prior to, during and/or while displacing the heavy fluids 208, the downhole tool 102 may be unset. The downhole tool 102 may be unset using any suitable method including, but not limited to, those described herein. Once circulation is complete, the work string may be pulled out of the wellbore 106.

Figure 3A:
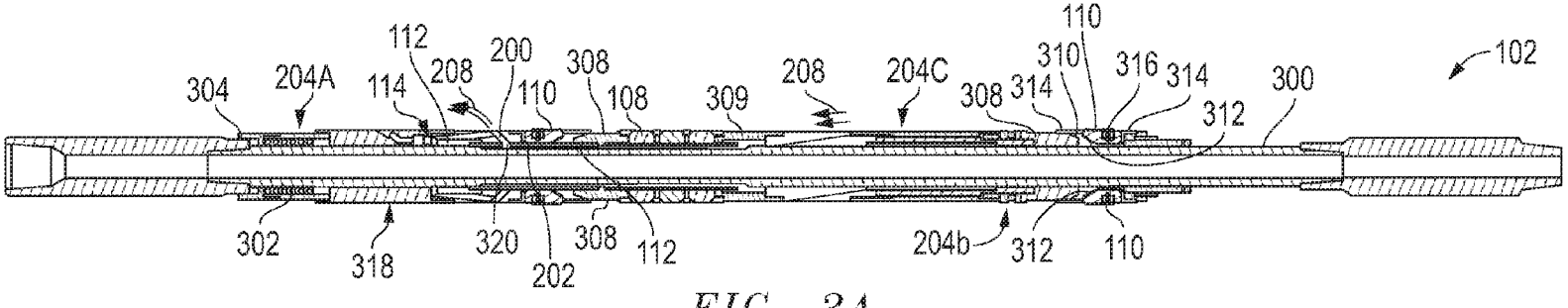
FIGS. 3A-3E depict cross sectional views of the downhole tool in various positions used in operation of the downhole tool.

FIG. 3A depicts a cross sectional view of the downhole tool 102 in the run in position according to an embodiment. As shown, the sealing elements 108, the anchor elements 110, the flow path 112, the valve 114, the run-in flow path 200, the sleeve 202, and the actuators 204 are located about and/or formed in a mandrel 300. As shown, there are three actuators 204A, 204B, and 204C on the downhole tool 102. The actuator 204A, as shown, is a release actuator that is biased toward the run in position, with a biasing member 302. The biasing member 302 as shown is a coiled spring, but may be any suitable biasing member. The biasing member 302 in the actuator 204 may release the downhole tool 102 from the set position as will be described in more detail below. In addition to the biasing member 302, a frangible member 304 may be used to secure the actuator 204A in the unactuated position. As shown, the frangible member 304 is a shear pin. The actuator 204B, as shown, is a hydraulic actuator located proximate the anchor elements 110 on the other side of the sealing element 108 from the actuator 204A. The actuator 204C, as shown, is a hydraulic actuator located proximate to the actuator 204B. The one or more frangible members 304 may be used in conjunction with any of the actuators 204. In an embodiment, the downhole tool 102 is actuated using only hydraulic actuators in order to limit excess weight being applied to the liner top during setting of the downhole tool 102. Because the downhole tool 102 according to an embodiment is not weight set, multiple sized downhole tools 102 may be run into the wellbore 106 simultaneously to test more than one liner on the same trip into the wellbore 106.

The downhole tool 102 may be maintained in the run in position until the downhole tool 102 reaches the set location. With the downhole tool 102 at the set location the actuator 204B and 204C may be used to set all, or a portion of the downhole tool 102 in the tubular 104. As shown, the actuator 204B may be initiated first to set the lower set of anchor elements 110. Pressure may be increased in the actuator 204B to move a slip block 308 toward the lower anchor element 110. As shown, the slip block 308 is a substantially cylindrical member having a slip surface 310 configured to engage an anchor element slip surface 312. The slip surface 310 may push the anchor element 110 radially away from the downhole tool and into engagement with the tubular 104. As shown, the slip block 308 is configured to travel under a portion of a guard 314 before engaging the anchor element 110. Once the lower anchor element 110 is set, the sealing element 108 and the upper anchor element 110 may be set using the actuator 204C to move the element retainer 309 as will be discussed in more detail below.

The guard 314 may be provided to protect the anchor elements 110 during run in. The guard 314 may be a sleeve around the downhole tool 102 that extends further (i.e. having a larger radius to its outer circumference) from the downhole tool 102 than the unactuated anchor elements 110. The guard 314 shown is cylindrical but the outer circumference of the guard may also be ramped or slanted to inhibit any edges that could potentially catch mud, debris, and/or the like. In addition to the guard 314 an anchor element biasing member 316 may bias the anchor elements 110 toward the retracted position (see FIG. 4A). The anchor element biasing member 316 as shown are coiled springs, however, any number and type of suitable biasing member may be used. The slip blocks 308 may travel under the guard 314 and into engagement with the anchor elements 110. The slip blocks 308 may then move the anchor elements 110 radially away from the downhole tool 102 beyond the circumference of guards 314 and into engagement with the tubular 104.

Once the slip block 308 engages the lower anchor elements 110 continued hydraulic pressure may allow the actuator 204C to actuate the sealing element 108 and/or the upper anchor element 110. The actuator 204C may motivate and/or move the element retainer 309. The element retainer 309 is configured to move the slip block 308, the sleeve 202, proximate the upper anchor element 110, and/or compress the sealing element 108. Although, the element retainer 309 is described as being an element retainer, the element retainer 309 may be any suitable retainer and/or piston configured to actuate the sealing element 108 and/or the anchor elements 110. As shown, the element retainer 309, upon actuation by the actuator 204C, moves the sealing element 108, the slip block 308, and the sleeve 202 toward the set position. The sleeve 202 may be coupled to the slip block 308 as shown. In addition, the element retainer 309 may compress the sealing element 108 in order to seal the annulus 116, as shown in FIG. 3B.

Figure 3B:
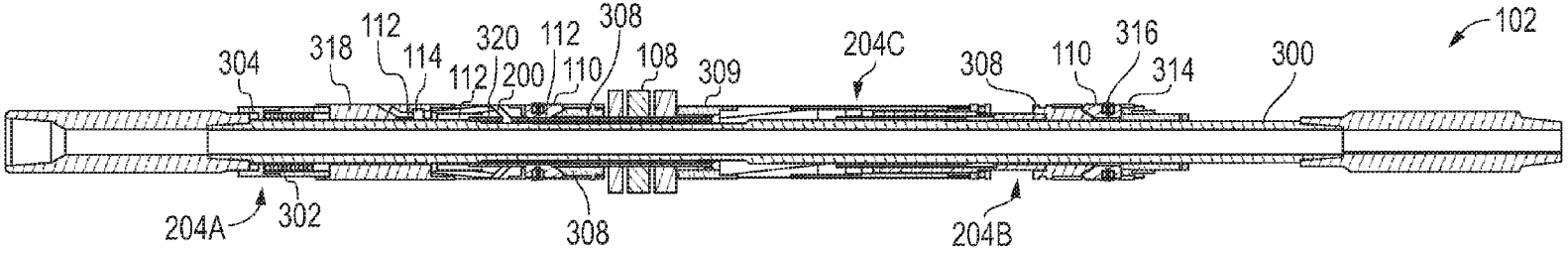

FIG. 3B depicts the actuators 204B and 204C actuated and the anchor elements 110 in the extended, or set position. Once the lower anchor elements 110 are engaged with the tubular 104, the sealing element 108 and/or any additional anchor elements 110 may be set using the actuator 204C. Subsequent to setting the upper anchor element 110, the element retainer 309 may compress the sealing element 108 thereby sealing the annulus 116 (as shown in FIGS. 1-2B). Although the actuators 204B and 204C are described as moving the element retainer 309, the slip block 308, and/or the sleeve 202, toward the set position, it should be appreciated that any actuators 204 described herein may set the downhole tool 102 in the set position. Further, in an alternative embodiment, a flow path mandrel 318 may be actuated while the sleeve 202 remains stationary in order to move the downhole tool 102 to the set position.

Figure 4B:
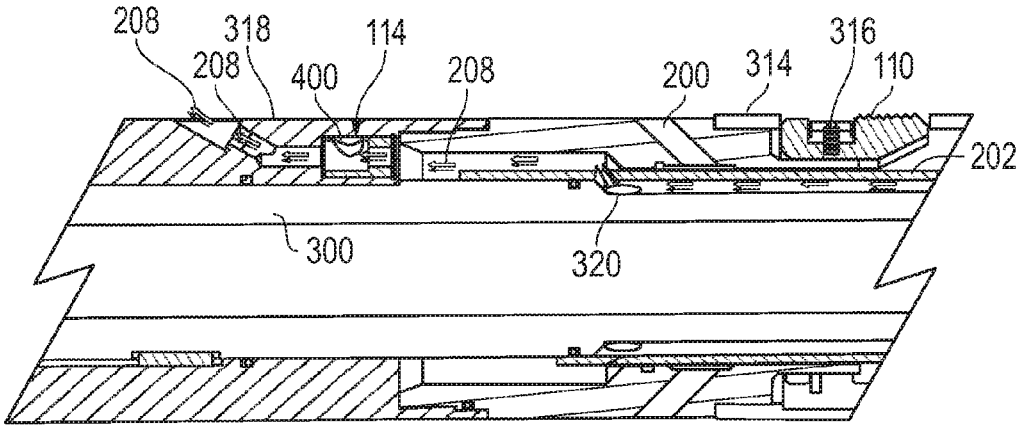

The movement of the element retainer 309, and thereby the sleeve 202, to the set position as shown in FIG. 3B may prohibit fluid communication with the run-in flow path 200 while placing the valve 114 in fluid communication with the flow path 112. The sleeve 202 may have an aperture 320 that aligns with the run-in flow path 200 in the run in position as shown in FIGS. 3A & 4A. The movement of the slip block 308 and the sleeve 202 may align the aperture 320 with the flow path 112 leading to the valve 114 as shown in FIGS. 3B & 4B. It should be appreciated that the sleeve 202 may be moved in addition to, the slip block 308 in order to allow for fluid communication with the valve 114.

Figure 3C:
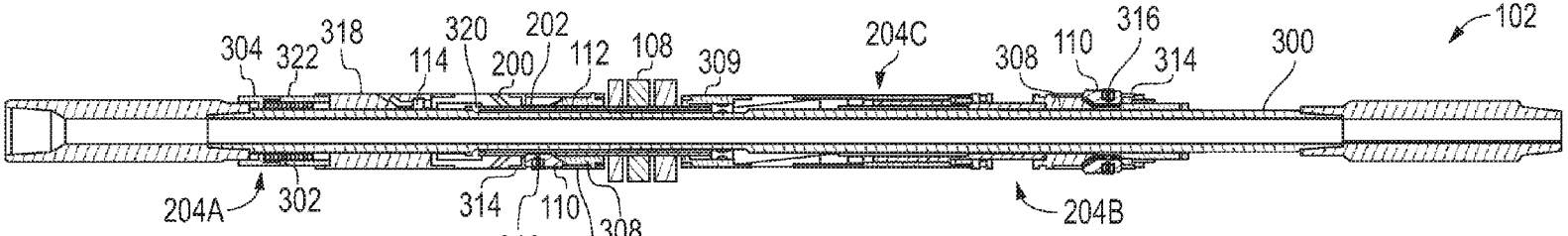

As shown in FIG. 3C, the downhole tool 102 is now in the set position. In the set position, the sealing element 108 has sealed the annulus 116 (as shown in FIGS. 1-2A) while the anchor elements 110 secure the downhole tool 102 in place. The run-in flow path 200 has been blocked by the sleeve 202. The aperture 320 in the sleeve 202 has established fluid communication with the flow path 112 leading to the valve 114. The valve 114 allows fluids to flow from one side, for example the downhole side, of the sealing element 108 to the other side, for example the up hole side, through the flow path 112 while preventing flow in the other direction. In the set position, the fluids in the wellbore 106 (as shown in FIGS. 1-2A) may be manipulated and controlled around the sealing element 108. The liner overlap 132 (as shown in FIG. 1) may then be pressure tested as described above.

The downhole tool 102 may remain in the wellbore 106 and/or the tubular 104 until the testing and/or cleaning operation is complete. To initiate release of the downhole tool 102, the actuator 204A may be used to disengage the one or more anchors elements 110 and the one or more sealing elements 108 in order to release the downhole tool 102.

Figure 3D:
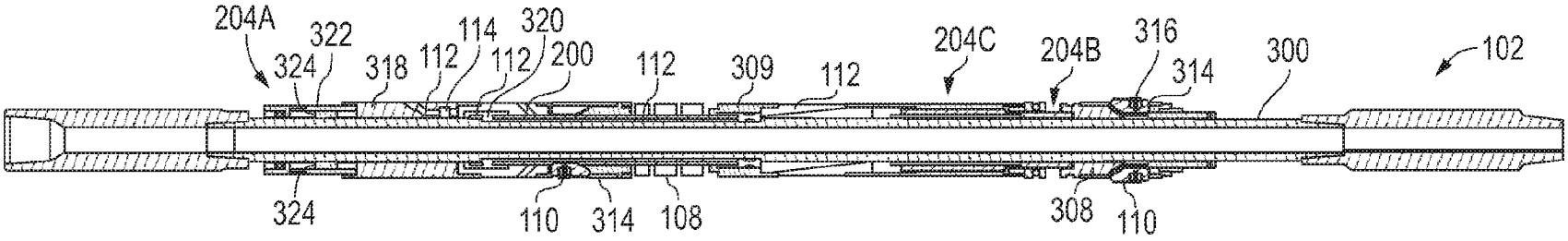

FIG. 3D depicts the downhole tool 102 releasing the one or more anchor elements 110 according to an embodiment. In this embodiment, the conveyance 122 and thereby the mandrel 300 are pulled up. The force up on the mandrel 300 may shear one or more fasteners 512D and 512E (shown if FIG. 5D) and break the frangible member 304 coupling the actuator 204A to the mandrel 300. Continued movement up of the mandrel 300 compresses the biasing member 302 located within the actuator 204A. The biasing member 302 exerts a force on a release piston 322, and a shoulder 324 coupled to the mandrel 300. The compressed biasing member 302 then begins to move the release piston 322 toward a released position. The release piston 322 may be connected to the flow path mandrel 318 and/or the anchor element 110. The continued movement of the release piston 322 moves the upper anchor element 110 down the slip block 308 and under the guard 314. The movement of the release piston 322 may also release the compression in the sealing element 108. In addition, continued upward movement of the mandrel 300 may break the frangible member 304 coupling the lower anchor elements 110 to the mandrel 300. With continued upward movement of the mandrel 300 may move any combination of the release piston 322, the flow path mandrel 318, the sealing element 108, the element retainer 309, the lower slip blocks 308 thereby releasing the lower anchor elements 110.

In an alternative embodiment, the actuators 204B and 204C may be used to release the anchor elements 110 and/or the sealing elements 108.

Figure 3E:
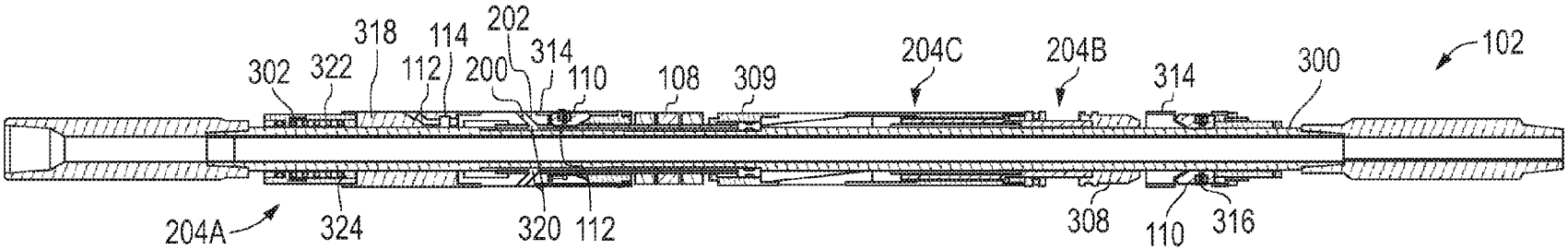

FIG. 3E depicts the downhole tool 102 in a released position according to an embodiment. In the released position, the anchor elements 110 are radially retracted within the guard 314. Further, the compression has been released from the sealing elements 108 and the sealing elements 108 may have retracted radially back within an outer diameter of the downhole tool 102. In the released position, the downhole tool 102 may be pulled out of the wellbore 106 and/or tubular 104 (as shown in FIG. 1) and/or moved to another location downhole.

FIG. 4A depicts a partial cross sectional view of the downhole tool 102 in the run in position according to an embodiment. As shown, the aperture 320 in the sleeve 202 may be aligned with the run-in flow path 200 in the run in position. Further, the sleeve 202 may be prohibiting fluid flow toward the valve 114. In this position, the heavy fluids 208 may flow through the downhole tool 102 during run in as described above. As shown, the valve 114 is a flapper valve having a flapper 400 in the closed position. Because fluid is not flowing below the valve 114, the fluid pressure above the valve 114 maintains the flapper 400 in the closed position.

FIG. 4B depicts a partial cross sectional view of the downhole tool 102 in the set position while displacing fluids from below the sealing element 108 according to an embodiment. In the set position, the sleeve 202 has been moved relative to the flow path mandrel 318. The movement of the sleeve 202 has aligned the aperture 320 of the sleeve 202 with the flow path 112 leading to the valve 114. Further, the sleeve 202 has cut off fluid flow to the run-in flow path 200. In addition, the anchor elements 110 and the sealing elements 108 may be engaged with the tubular 104 as shown in FIGS. 2B and 3C. The fluids, for example the heavy fluids 208, may now flow toward the valve 114. The fluids may open the flapper 400, as shown, thereby allowing fluid flow past the sealed sealing element 108. The heavy fluids 208 may then be forced to a location above the sealing element 108 in order to test the liner overlap 132 (as shown in FIG. 2C).

Figure 4C:
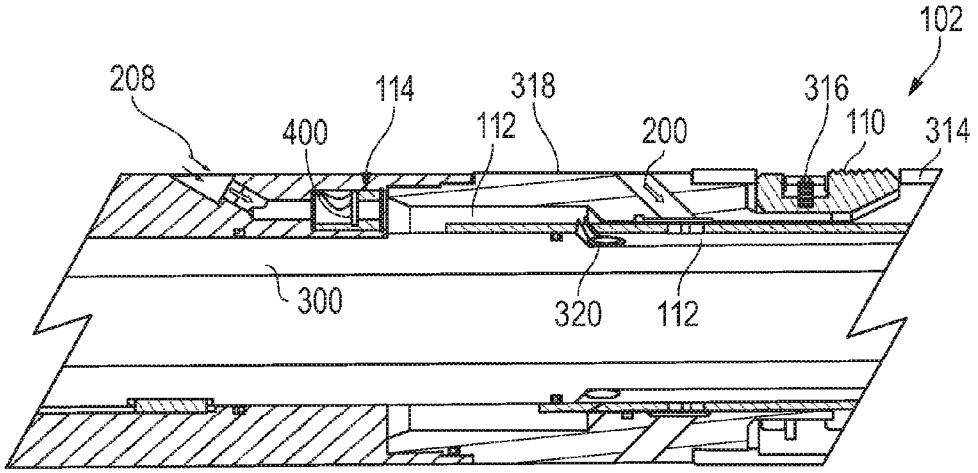

FIG. 4C depicts a partial cross sectional view of the downhole tool 102 in the set position during the liner overlap 132 pressure test, or test position according to an embodiment. In the test position, the downhole tool 102 is secured to the tubular 104 and the heavy fluids 208 have been evacuated from the liner overlap 132 area. Higher pressure above the valve 114 has closed the flapper 400 in the valve 114. The closed valve 114 prevents the heavier fluids from flowing back toward the liner overlap 132 location. The lighter fluids 210 may be used to pressure test the liner overlap 132 as described above, while the heavier fluids maintain the valve 114 in the closed position.

Figure 4D:
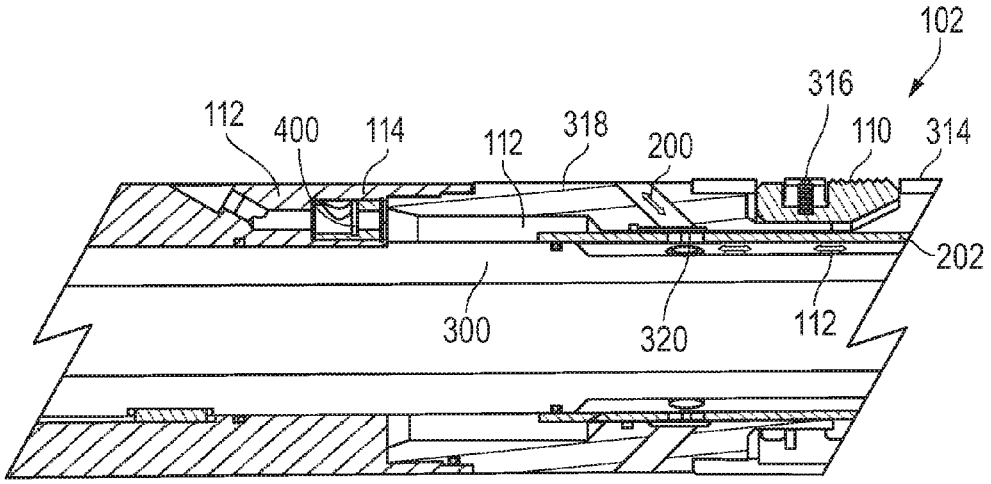

FIG. 4D depicts a partial cross sectional view of the downhole tool 102 in the release position according to an embodiment. In the release position, the anchor elements 110 are recessed, i.e. have been moved radially in to a location within or internal to the guard 314. The aperture 320 in the sleeve 202 has been realigned with the run-in flow path. The sleeve 202 has also prohibited communication with the flow path 112 leading to the valve 114. The flapper 400 in the valve 114 has remained in the closed position as the pressure below the valve has remained low or been eliminated by the sleeve 202 closing the flow path 112. In the release position, the downhole tool 102 may be removed from the wellbore 106 and/or moved to another location in the wellbore 106.

The portions of the downhole tool 102 secured about the mandrel 300 may be keyed together to prevent relative rotational movement, and/or longitudinal movement, between the portions. The keyed configuration may allow the portions to move longitudinally relative to one another, while preventing the rotation. Further, the keyed configuration may allow the mandrel 300 to rotate relative to the portions of the downhole tool 102 about the mandrel 300 except when the sealing element 108 is set. This may allow the operator to perform further downhole operations using the mandrel 300.

Once the downhole tool 102 is in the release position, it may be desirable to perform further downhole operations with the downhole tool 102. These downhole operations may be any suitable operation including, but not limited to, cleaning, milling, boring, any of the operations described herein, and the like. In order to ensure that the engagement members 110 of the downhole tool 102 do not inadvertently re-engage the tubular 104, the engagement members 110 and/or the slip blocks 308 (see FIG. 3B) may need to be locked in a retracted position.

Figure 5A:
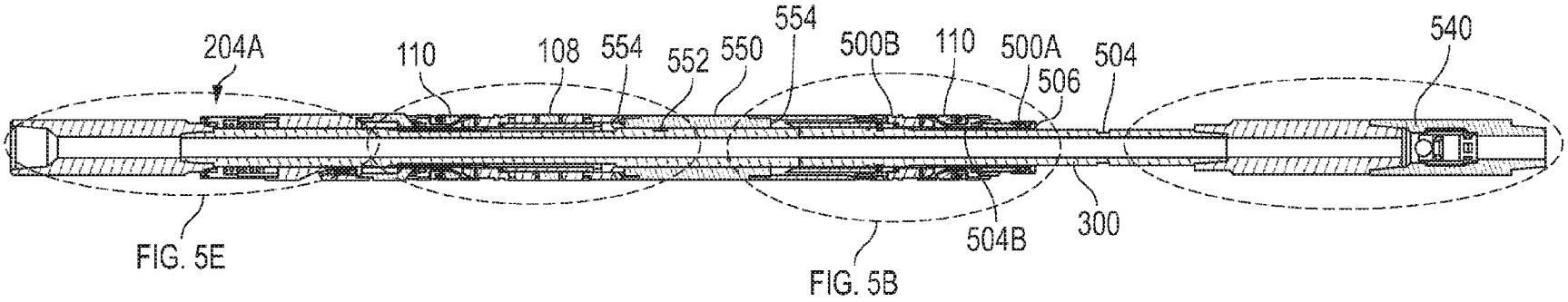
FIGS. 5A-5E depict cross sectional views of the downhole tool in various positions used in operation of the downhole tool.

FIG. 5A depicts an alternative view of the downhole tool 102. The alternative downhole tool 102 may have one or more locks 500 configured to prevent the engagement members 110 from inadvertently engaging the tubular 104. The locks 500 may be configured to lock the lower anchor elements 110 and/or the slip blocks 308 in a secure position after the downhole tool 102 has been released from the tubular 104. The one or more locks 500, as shown, are c-rings 502 (or snap rings) (see FIG. 5B) configured to engage one or more grooves 504 on the mandrel 300. There may be one lock 500 for locking the engagement members 110 and/or the slip blocks 308 to the mandrel 300 or there may be several locks 500 for locking the engagement members 110 in a first location and the slip blocks 308 in a separate location spaced away from the engagement members 110.

In the embodiment shown in FIG. 5A, there are two locks 500A and 500B. A first lock 500A is configured to lock the engagement members 110 to the groove 504A located toward a bottom end of the mandrel 300. A second lock 500B is configured to lock the lower slip block 308 to the groove 504B at a location higher on the mandrel 300. Moreover, a connection cylinder 550 is made of sufficient length to maintain a key 552 inside the periphery ends 554 of the connection cylinder 550 during operation or manipulation of the downhole tool 102 and/or mandrel 300.

Figure 5B:
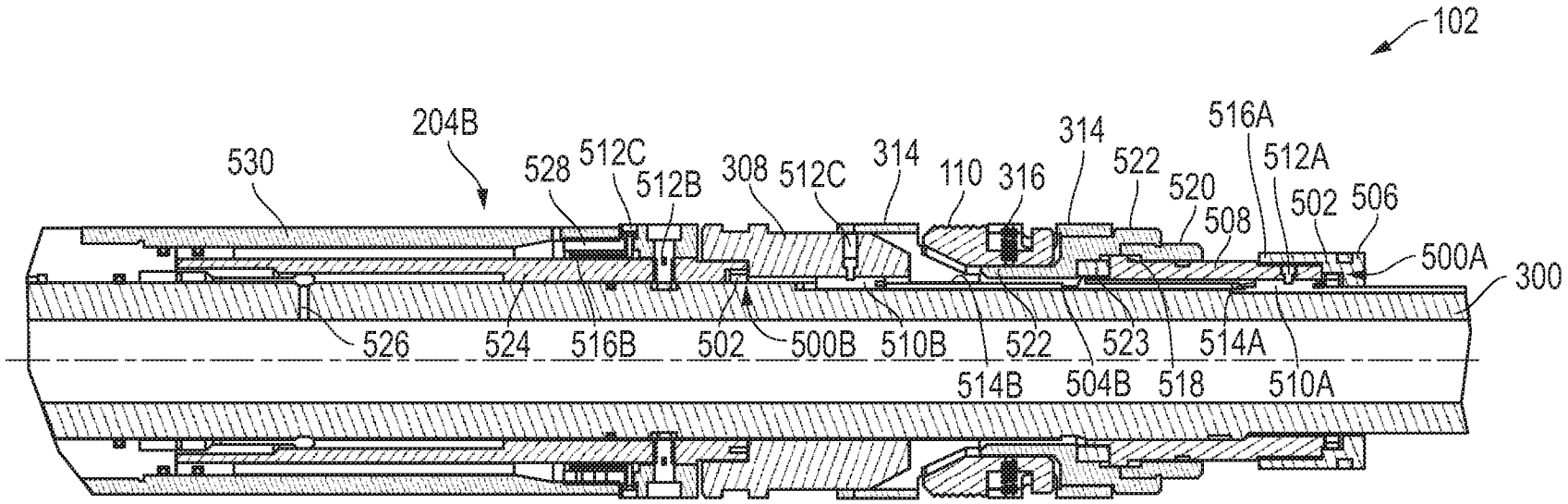

FIG. 5B depicts a cross-sectional view of a portion of the downhole tool 102 shown in FIG. 5A. The lower lock 500A may have a snap ring holder 506 configured to house the c-ring 502. The snap ring holder 506 may be configured to couple to or be motivated by a shear housing 508. The shear housing 508 may couple to a key 510A with a fastener 512, or frangible member. The key 510A may be configured to travel in a key slot 514A in order to prevent the snap ring holder 506, the lock 500 and/or the engagement members 110 from rotating about the mandrel 300 relative to one another. The shear housing 508 may be configured to engage the snap ring holder 506 via a fastening system 516A (e.g. a threaded connection). The fastening system 516A may allow the shear housing 508 to be secured into the snap ring holder 506 during installation, while preventing the shear housing 508 from moving in the opposite direction and thereby becoming inadvertently released from the snap ring holder 506. The fastening system 516A may allow the snap ring holder 506 to rotate relative to the shear housing 508 while preventing relative longitudinal movement. Although the snap ring holder 506 is shown as being coupled to the shear housing 508 via the fastening system 516A, any suitable device may be used to prevent relative movement including, but not limited to, threads, a fastener, a screw, a pin, and the like.

The shear housing 508 may have a shear housing shoulder 518 configured to engage a lower slip support nut 520. The lower slip support nut 520 may be coupled to a slip support 522 via a threaded connection, or any other suitable connection such as those described herein. The slip support 522 may couple to the lower slip guard 314 via a threaded connection, or any other suitable connection such as those described herein. The slip support 522 may hold the engagement members 110 in a fixed lateral and/or rotational position relative to the lower slip blocks 308. A biasing member 523 may be compressed between the shear housing 508 and the slip support 522 in order to bias the shear housing 508 and thereby the lock 500A down the mandrel 300 once the fastener 512A is removed or sheared as will be discussed in more detail below.

The lower slip block 308 may be configured to lock to the mandrel 300 with the lock 500B. The lock 500B may have the c-ring 502 located between an upper end of the lower slip block 308 and a setting piston 524 of the actuator 2048. The setting piston 524 may be coupled to the lower slip blocks 308 via a threaded connection, or any other suitable connection including, but not limited to, those described herein. The setting piston 524 may be coupled to the mandrel 300 via a fastener 512B, or frangible member, prior to setting the engagement members 110 in the tubular 104 (as shown on FIG. 1). The lower slip blocks 308 may be coupled to a key 510B configured to travel in a key slots 514B. The key 510B and key slot 514B may prevent the rotation of the lower slip blocks 308 relative to the engagement members 110 while allowing relative longitudinal movement. The lower slip blocks 308 may couple to the key 510B via a fastener 512C, or frangible member. One or more ports 526 (preferably, but not limited to, three ports 526) may provide fluid pressure to the setting piston 524 in order to set the engagement members 110 in the tubular 104 as described above.

A lock nut housing 528 may be configured to secure a housing around the actuator 204C. The lock nut housing 528 may couple to the housing 530 via a threaded connection, or any suitable connection including, but not limited to, those described herein. A fastener 512C may further secure the lock nut housing 528 to the housing 530. The ratchet system 516B may be located between the setting piston 524 and the lock nut housing 528. The ratchet system 516B may allow the setting piston 524 to extend toward the set position while preventing the setting piston from moving in the opposite direction. In another embodiment, the ratchet system 516B may allow bi-directional movement between the setting piston 524 and the lock nut housing 528.

The housing 530 may be extended in order to allow the setting piston 524 to travel beyond the set position. Allowing the setting piston 524 to travel beyond the set position may allow the setting piston 524, and/or the actuator 204B to move the locks 500A and 500B to a locked position, as will be discussed in more detail below.

Figure 5C:
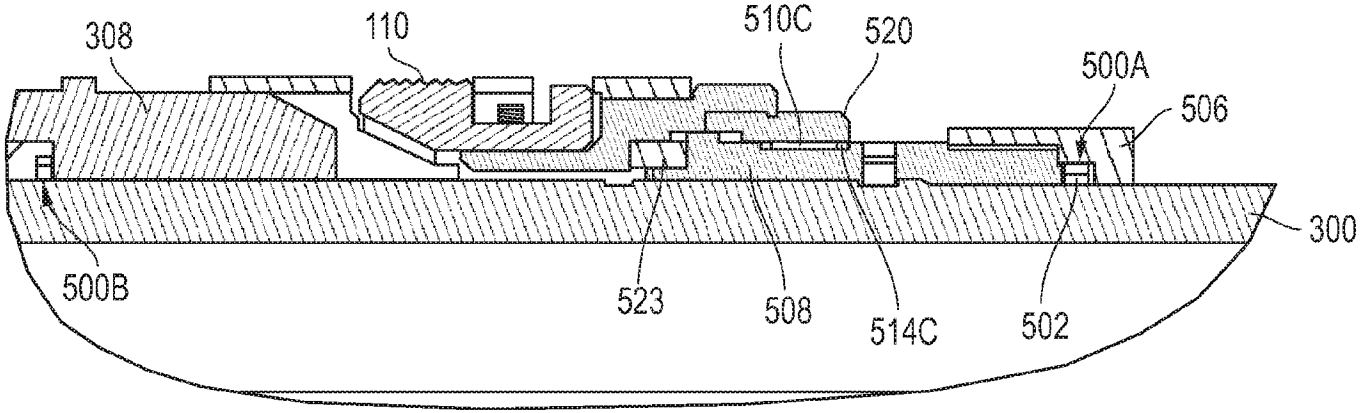

FIG. 5C depicts a partial cross sectional view of the downhole tool 102 of FIG. 5A proximate the locks 500A and 500B and the engagement member 110 and rotated relative to the view in FIG. 5A. As shown a key 510C may be located in a key slot 514C. The key slot 514C may be between the lower slip support nut 520 and the shear housing 508. The key 510C and key slot 514C may prevent relative rotation between the shear housing 508 and the lower slip support nut 520 while allowing relative longitudinal movement.

Figure 5D:
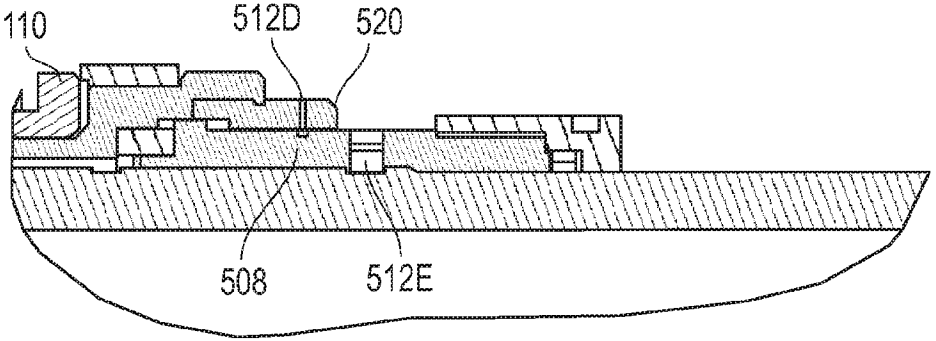

FIG. 5D depicts a partial cross sectional view of the downhole tool 102 of FIG. 5A proximate the lock 500B and rotated relative to the views in FIGS. 5A and 5B. As shown, a fastener 512D, or frangible member, may couple the lower slip support nut 520 to the shear housing 508. The fastener 512D may be configured to shear only after the circulation operation is performed and the downhole tool 102 is to be moved to another location in the tubular 104 (as shown in FIG. 1). A fastener 512E may be configured to couple the shear housing 508 to the mandrel 308. The fastener 512E is configured to shear during releasing movement from set position.

The frangible fasteners on the downhole tool 102 for example, fasteners 512B (setting), 512D (release) and 512E (release) may be configured to remain within the downhole tool 102. Fasteners 512A and 512C preferably, but not necessarily, are not frangible and may, for example, be cap screws also configured to remain within the downhole tool 102. For example, a portion of the lock nut housing 528 covers the frangible fastener 512B, and the guard 314 covers the fastener 512C. The covers on the fasteners 512 may protect and/or prevent the fasteners 512, or portions thereof, from exiting the downhole tool 102 during downhole operations. This may keep the downhole environment free from debris from the downhole tool 102.

Figure 5E:
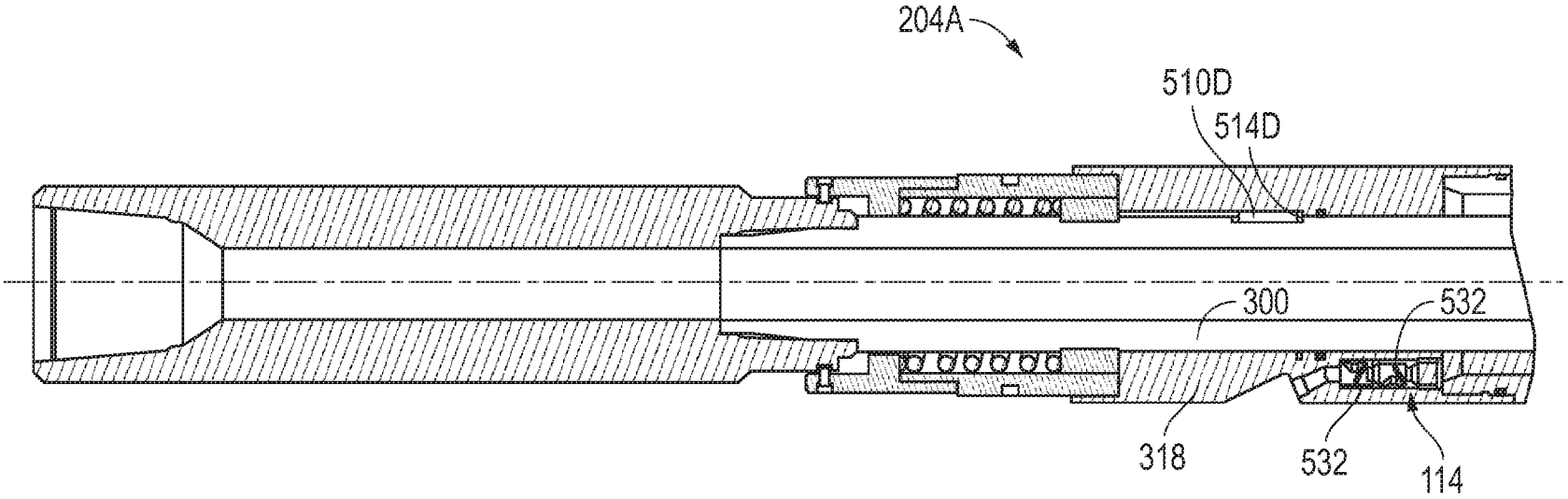

FIG. 5E depicts a cross-sectional view of the downhole tool of FIG. 5A proximate the actuator 204A. A key 510D may couple the flow path mandrel 318 to the mandrel 300. The key 510D may travel in a key slot 514D thereby preventing the relative rotation between the flow path mandrel 318 and the mandrel 300. In an alternative embodiment, the key 510D, and/or any keys 510A-510D, may prevent relative rotational movement while allowing longitudinal movement. As shown in FIG. 5E, the one or more valves 114 are two flapper valves 532 fluidly coupled to one another in series. The two flapper valves 532 may provide a redundancy in order to prevent the fluid from back flowing through the flow path 112. Although the one or more valves 114 are shown as two flapper valves 532, the one or more valves 114 may be any suitable number and type of valves including, but not limited to, check valves, any valves described herein and the like.

The c-ring 502 may be a ring with a gap, or a portion cut away from the c-ring 502. The c-ring 502 may be placed about the mandrel 300 and biased toward a position smaller than the outer circumference of the mandrel 300. Therefore, when the c-ring 502 encounters the groove 504, the c-ring 502 will automatically move into the groove 504 thereby locking the engagement members 110 and/or the slip blocks 308. Although the locks 500A and 500B are described as being c-rings 502 engaging grooves 504, it should be appreciated that the locks 500A and 500B may be any suitable locks including, but not limited to, collets, biased pins, any locks described herein, and the like. Although the locks 500 are discussed as naturally biased to close or lock when the respective groove 504 is matched, any respective lock 500 could also be designed to bias toward the open, unlocked position.

Figure 6A:
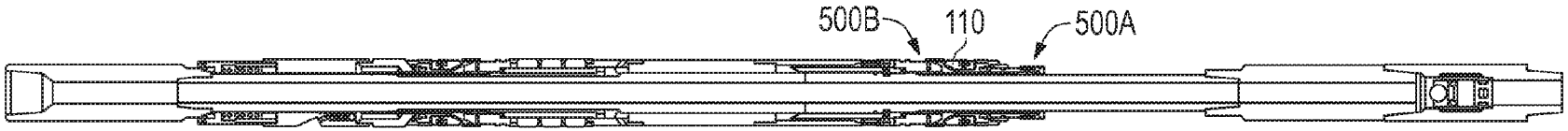
FIGS. 6A-6C depict cross sectional views of the downhole tool of FIG. 5A in the set position, the released position and a locked out position.

During the setting of the engagement members 110, the pressure through the port(s) 526 may motivate the setting piston 524 thereby shearing the fastener 512B. The setting piston 524 may then move the lower slip blocks 308 to move the engagement members 110 to the engaged position, as shown in FIG. 6A. In this engaged position, any suitable downhole operations may be performed including those described herein. The mandrel may be rotated, and/or moved longitudinally before setting or after release in order to perform additional operations.

Figure 6B:
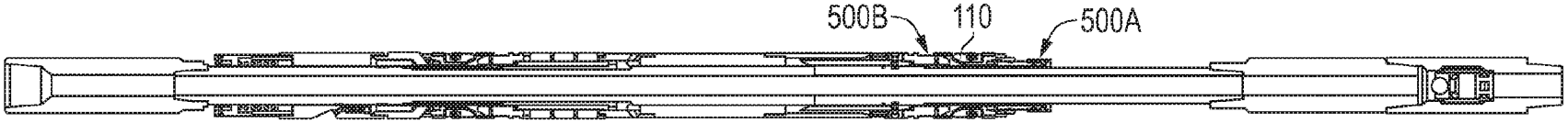

After the circulation operation, the engagement members 110 and/or the sealing elements 108 may be disengaged from the tubular 104 (as shown in FIG. 1). In one embodiment shown in FIG. 6B, the downhole tool 102 may be lifted, or pulled, up against the engaged engagement members 110. The lifting up of the downhole tool 102 may shear fasteners 512D and/or 512E in order to allow the locks 500A and 500B and/or the engagement members 110 and lower slip blocks 308 to move longitudinally relative to one another.

Once one or some of the fastener(s) 512A, 512C, 512D and/or 512E have been sheared, continued pulling up may move lock nut housing 528 and the housing 530 up relative to the setting piston 524, the locks 500A and 500B, and/or the lower engagement members 110. The lower slip blocks 308, the engagement members 110, and/or the locks 500A and 500B may then begin to move down relative to the mandrel 300. The locks 500A and 500B may lock into place as shown in FIG. 6C with the continued upward motion of the mandrel 300.

Figure 6C:
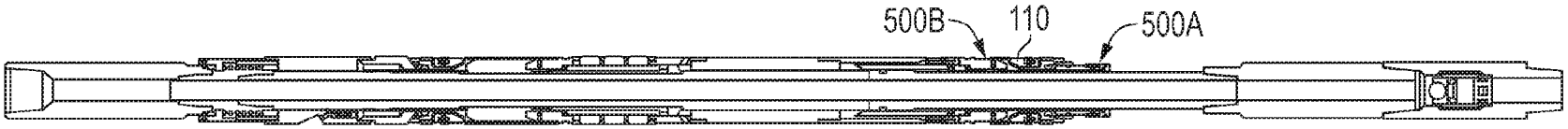

FIG. 6C depicts a cross sectional view of the downhole tool in a locked out position. As shown in FIG. 6C, the c-ring 502 of the lock 500B may engage the groove 504B with the movement of the mandrel 300 in the upward position. The lock 500B may secure the lower slip blocks 308 in a fixed longitudinal location on the mandrel 300. Continued pulling of the mandrel 300 may move the slip blocks 308 up with the mandrel 300 while allowing the engagement members 110 and the lock 500A to move down relative to the mandrel 300. The lock 500A may move down relative to the mandrel 300 until the c-ring 502 engages the groove 504A as shown in FIG. 6C, thereby locking out the lower slip blocks 308 and the lower engagement members 110 from inadvertently engaging the tubular 104.

In the locked out position, the downhole tool 102 may be moved to other locations downhole in order to perform downhole operations. The locks 500 may prevent the engagement members 110 and/or the sealing members 108 from inadvertently engaging the tubular 104 in the lockout position.

Figure 7:
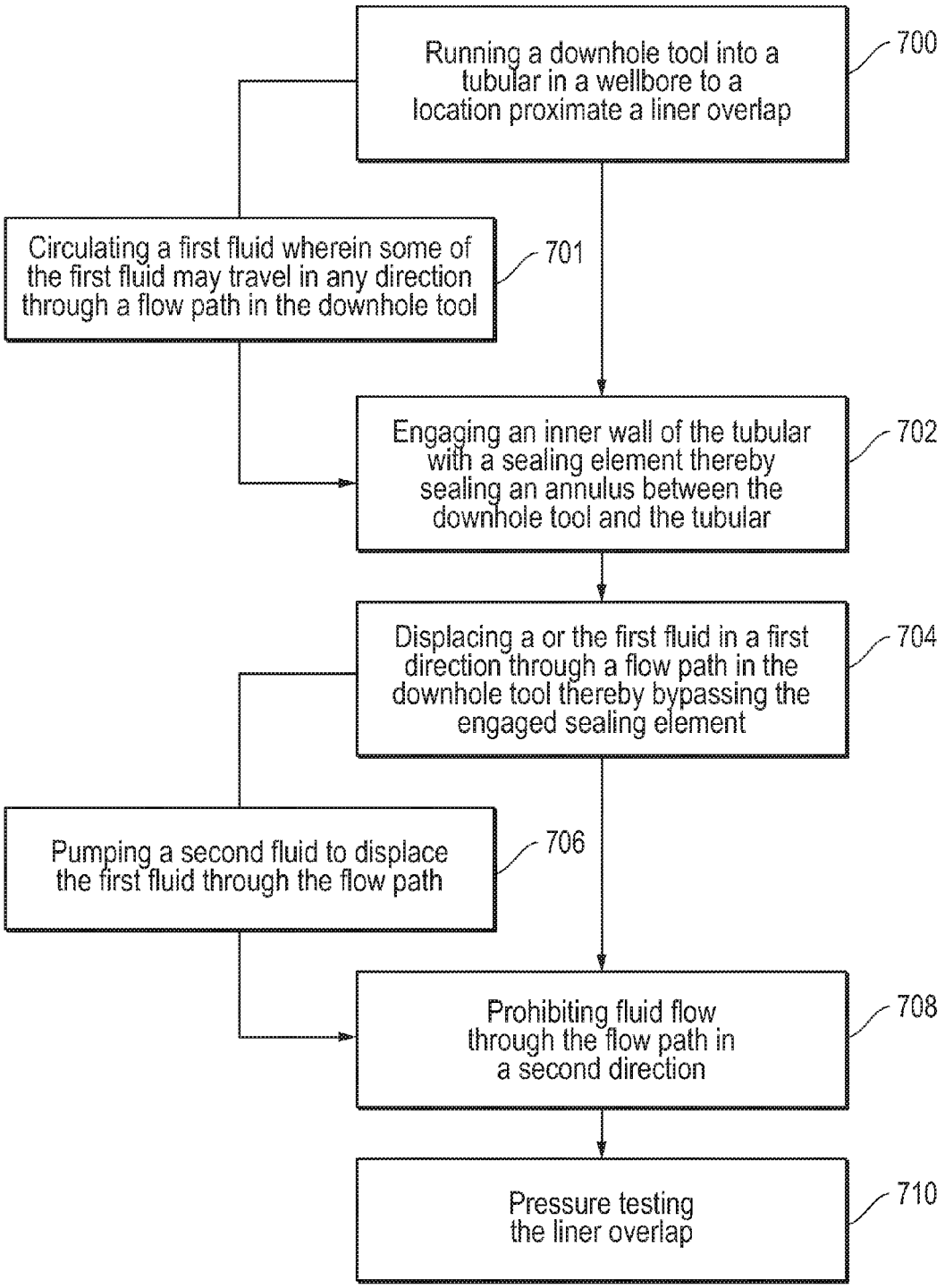
FIG. 7 depicts a method for testing a liner overlap in a wellbore.

FIG. 7 depicts a flow chart depicting a method for testing the liner overlap 132 in the wellbore. The flow chart begins at block 700 wherein the downhole tool 102 is run into the tubular 104 in the wellbore to the location proximate the liner overlap 132. The flow chart optionally continues at block 701 wherein the first fluid is circulated wherein some of the first fluid may travel in any direction through the flow path 112 in the downhole tool 102. The flow chart continues at block 702 wherein the inner wall of the tubular 104 is engaged with the sealing element 108 thereby sealing the annulus between the downhole tool 102 and the tubular 104. The flow chart continues at block 704 wherein the first fluid is displaced in a first direction through a flow path 112 in the downhole tool 102 thereby bypassing the engaged sealing element 108. The flow chart optionally continues at block 706 wherein the second fluid is optionally pumped into the wellbore to displace the first fluid through the flow path 112. The flow chart continues at block 708 wherein fluid flow is prohibited in a second direction through the flow path 112. The flow chart continues at block 710 wherein the liner overlap 132 is pressure tested. In an embodiment, the pressure test of the liner overlap 132 is performed with the second fluid. While the embodiments are described with reference to various implementations and exploitations, it will be understood that these embodiments are illustrative and that the scope of the inventive subject matter is not limited to them. Many variations, modifications, additions and improvements are possible. For example, the techniques used herein may be applied to any downhole packers.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A method for testing a liner overlap in a wellbore, comprising:

running a downhole tool having an axial throughbore into a tubular in the wellbore to a location proximate the liner overlap;

engaging an inner wall of the tubular with a sealing element thereby sealing an annulus between the downhole tool and the tubular;

displacing a first fluid in the annulus in a first direction through a bypass flow path in the downhole tool thereby bypassing the engaged sealing element;

closing a valve in the bypass flow path, thereby prohibiting fluid flow through the bypass flow path in a second direction, wherein the valve is selected from the group consisting of a check valve and a flapper valve; and pressure testing the liner overlap.

2. The method of claim 1, wherein running the downhole tool into the tubular further comprises displacing the first fluid past the sealing element through a run-in flow path.

3. The method of claim 2, further comprising prohibiting fluid flow through the run-in flow path and establishing fluid communication with the valve.

4. The method of claim 1, wherein pressure testing the liner overlap is performed with a second fluid.

5. The method of claim 4, further comprising pumping the second fluid to displace the first fluid through the bypass flow path.

6. The method of claim 1, wherein the second direction is opposite to the first direction.

7. The method of claim 1, further comprising locking out an anchor element on the downhole tool.

8. A method for testing a liner overlap in a wellbore, comprising:

running a downhole tool having an axial throughbore into a tubular in the wellbore to a location proximate the liner overlap;

engaging an inner wall of the tubular with a sealing element thereby sealing an annulus between the downhole tool and the tubular;

displacing a first fluid in the annulus in a first direction through a bypass flow path in the downhole tool thereby bypassing the engaged sealing element;

prohibiting fluid flow through the bypass flow path in a second direction;

pressure testing the liner overlap, wherein pressure testing the liner overlap is performed with a second fluid; and pumping the second fluid to displace the first fluid through the bypass flow path.

9. The method of claim 8, wherein the prohibiting comprises closing a valve in the bypass flow path, and wherein the valve is selected from the group consisting of a check valve and a flapper valve.

10. The method of claim 9, wherein running the downhole tool into the tubular further comprises displacing the first fluid past the sealing element through a run-in flow path.

11. The method of claim 10, further comprising prohibiting fluid flow through the run-in flow path and establishing fluid communication with the valve.

12. The method of claim 8, wherein the second direction is opposite to the first direction.

13. The method of claim 8, further comprising locking out an anchor element on the downhole tool.

14. A method for testing a liner overlap in a wellbore, the method comprising:

running a downhole tool having an axial throughbore into a tubular in the wellbore to a location proximate the liner overlap;

engaging an inner wall of the tubular with a sealing element, thereby sealing an annulus between the downhole tool and the tubular;

flowing a first fluid in a first direction through a bypass flow path in the downhole tool, thereby bypassing the engaged sealing element;

preventing flow through the bypass flow path in a second direction opposite to the first direction while the sealing element is engaged with the inner wall of the tubular, and while flow through the bypass flow path in the first direction is permitted; and pressure testing the liner overlap.

15. The method of claim 14, wherein preventing flow through the bypass flow path in the second direction further comprises closing a valve in the bypass flow path.

16. The method of claim 15, wherein the valve is selected from the group consisting of a check valve and a flapper valve.

17. The method of claim 16, wherein running the downhole tool into the tubular further comprises displacing the first fluid past the sealing element through a run-in flow path.

18. The method of claim 17, further comprising prohibiting fluid flow through the run-in flow path and establishing fluid communication with the valve.

19. The method of claim 14, wherein pressure testing the liner overlap is performed with a second fluid.

20. The method of claim 19, further comprising pumping the second fluid to displace the first fluid through the bypass flow path.

21. The method of claim 14, further comprising locking out an anchor element on the downhole tool.

* * * * *